US010260136B2

(12) United States Patent
Yoon

(10) Patent No.: US 10,260,136 B2
(45) Date of Patent: Apr. 16, 2019

(54) ALUMINUM ALLOY FOR DIE CASTING AND METHOD OF HEAT TREATING THE SAME

(71) Applicant: Hyundai Motor Company, Seoul (KR)

(72) Inventor: Hyung Sop Yoon, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 281 days.

(21) Appl. No.: 15/278,668

(22) Filed: Sep. 28, 2016

(65) Prior Publication Data

US 2017/0314111 A1 Nov. 2, 2017

(30) Foreign Application Priority Data

Apr. 27, 2016 (KR) ..... 10-2016-0051200

(51) Int. Cl.

| | |
|---|---|
| ***C22F 1/043*** | (2006.01) |
| ***C22C 21/02*** | (2006.01) |
| ***B22D 18/06*** | (2006.01) |
| ***B22D 21/00*** | (2006.01) |

(52) U.S. Cl.

CPC ..... *C22F 1/043* (2013.01); *B22D 18/06* (2013.01); *B22D 21/007* (2013.01); *C22C 21/02* (2013.01)

(58) Field of Classification Search

None

See application file for complete search history.

(56) References Cited

U.S. PATENT DOCUMENTS 7,625,454 B2 12/2009 Lin et al.
2002/0053373 A1* 5/2002 Feikus ..... C22F 1/043 148/417
2003/0041934 A1* 3/2003 Lumley ..... C22F 1/04 148/698
2003/0047250 A1* 3/2003 Takasaki ..... C22F 1/043 420/532
2003/0143102 A1* 7/2003 Matsuoka ..... C22F 1/043 420/532
2005/0076977 A1* 4/2005 Lumley ..... C22F 1/043 148/698
2009/0038720 A1* 2/2009 Lumley ..... C22C 21/02 148/695
2010/0224293 A1* 9/2010 Wang ..... C22C 21/02 148/701
2013/0186525 A1* 7/2013 Koch ..... B22D 21/007 148/549

FOREIGN PATENT DOCUMENTS

| | | | | |
|---|---|---|---|---|
| GB | 2128205 | A | * | 4/1984 |
| JP | 05/179384 | | * | 7/1993 |
| JP | H05179384 | A | | 7/1993 |
| JP | 2008-514807 | A | | 5/2008 |
| JP | 2009-024265 | A | | 2/2009 |
| KR | 2002-0077184 | A | | 10/2002 |
| KR | 10-0648487 | B1 | | 11/2006 |
| KR | 2014-0091858 | A | | 7/2014 |
| KR | 10-1571665 | B1 | | 11/2015 |
| WO | 2006/014948 | A2 | | 2/2006 |

OTHER PUBLICATIONS

English translation of JP 05/179384, Jul. 1993; 7 pages.*

* cited by examiner

*Primary Examiner* — Helene Klemanski
(74) *Attorney, Agent, or Firm* — Mintz Levin Cohn Ferris Glovsky and Popeo, P.C.; Peter F. Corless

(57) ABSTRACT

Disclosed are an aluminum alloy composition for die casting and a method of heat treating the same. The aluminum alloy composition contains precipitation of an Mg—Zn-based strengthening phase through heat treatment to thus enhance strength thereof.

17 Claims, 14 Drawing Sheets

ALUMINUM ALLOY FOR DIE CASTING AND METHOD OF HEAT TREATING THE SAME

CROSS REFERENCE TO RELATED APPLICATION

The present application claims priority to Korean Patent Application No. 10-2016-0051200, filed Apr. 27, 2016, the entire contents of which is incorporated herein for all purposes by this reference.

TECHNICAL FIELD

The present invention relates to an aluminum alloy composition that may be suitable for die casting and a method of heat treating the same. In particular, the aluminum alloy composition may include precipitation of an Mg—Zn-based strengthening phase formed by heat treatment and thus may have substantially improved strength thereof.

BACKGROUND OF THE INVENTION

As being easily cast, being efficiently alloyed with other metals, exhibiting high corrosion resistance in air, and having high electrical and thermal conductivities, aluminum has been widely utilized in industry.

In particular, aluminum has been mostly used to reduce the weight of vehicles and to increase fuel efficiency, and has been provided in the form of an aluminum alloy, by mixing aluminum with other metals, because the strength of aluminum itself may not be sufficient as compared to the other metals such as iron.

The aluminum alloy has been manufactured by die-casting, which is a precision casting process in which a molten metal is injected into a mold having a cavity that is mechanically processed at high precision in accordance with the shape of the product to be cast, thus obtaining a cast product having the same shape as that of the cavity.

Meanwhile, the aluminum alloy for die casting has to possess properties suitable for use in a process of filling the cavity of the mold with a high-speed high-pressure molten metal within a short time (for example, within 0.1 to 0.3 sec) to solidify it. In particular, appropriate high-temperature viscosity and latent heat may be required, thereby ensuring flowability suitable for high-pressure casting and mitigating shrinkage defects upon solidification.

Examples of aluminum alloys that have been known for use in die casting include ADC10 alloy that contains an amount of about 8 to 12 wt % of silicon (Si) to thus show properties suitable for the die-casting process and A380 alloy that contains an amount of about 2 to 4 wt % of copper (Cu) to ensure the strength required of structural material even without additional heat treatment.

The ADC10 and A380 alloys also include iron (Fe) in a maximum amount of about 1.3 wt % in order to minimally inhibit seizure and corrosion between the aluminum melt and the mold. Typically, side effects including low elongation due to an excess of Fe acicular structure are minimized through structural fineness using quenching, thus enabling the recycling of the alloy, thereby increasing productivity and work convenience.

The ADC10 and A380 alloys may constitute 90% or greater of all alloys for die casting, because of the many advantages thereof, including their properties and high productivity.

When a die-casting process is commonly applied, no heat treatment has been known to be carried out. Recently, however, many attempts have been made to increase alloy strength using high-vacuum die-casting techniques or heat treatment techniques having a short solution treatment time.

The foregoing is intended merely to aid in the understanding of the background of the present invention, and is not intended to mean that the present invention falls within the purview of the related art that is already known to those skilled in the art.

SUMMARY OF THE INVENTION

In preferred aspects, the present invention provides an aluminum alloy composition that may be suitably used for die casting and a method of heat treating the same. In particular, the method of heat treating the aluminum alloy composition of the present invention suitably may form precipitation of a Zn-based strengthening phase, instead of a conventional Cu-based strengthening phase, thereby improving strength through heat treatment.

In one aspect of the present invention, provided is an aluminum alloy composition for die casting. The aluminum alloy composition may comprise: silicon (Si) in an amount of about 9.6 to 12.0 wt %; magnesium (Mg) in an amount of about 1.5 to 3.0 wt %; zinc (Zn) in an amount of about 3.0 to 6.0 wt %; iron (Fe) in an amount of about 1.3 wt % or less but greater than 0 wt %; manganese (Mn) in an amount of about 0.5 wt % or less but greater than 0 wt %; nickel (Ni) in an amount of about 0.5 wt % or less but greater than 0 wt %; tin (Sn) in an amount of about 0.2 wt % or less but greater than 0 wt %; and aluminum (Al) constituting the remaining balance of the aluminum alloy composition. Unless otherwise indicated herein, all the wt % are based on the total weight of the aluminum alloy composition.

The aluminum alloy may further include copper (Cu) in an amount of about 0.3 wt % or less, based on the total weight of the aluminum alloy composition. In addition, the aluminum alloy may further include titanium (Ti) in an amount of about 0.3 wt % or less, based on the total weight of the aluminum alloy composition. The aluminum alloy may further include copper (Cu) in an amount of about 0.3 wt % or less and titanium (Ti) in an amount of about 0.3 wt % or less, based on the total weight of the aluminum alloy composition.

Preferably, the sum of amounts of Mg and Zn may be of about 6 to 8 wt %, based on the total weight of the aluminum alloy composition.

Preferably, the aluminum alloy composition may have a ratio of Mg/Zn ratio about 2.0 or greater.

The aluminum alloy suitably may have a yield strength of about 300 MPs or greater.

The aluminum alloy suitably may have a tensile strength of about 350 MPs or greater.

The aluminum alloy suitably may have an elongation of about 2% or greater.

Further provided is the aluminum alloy composition that may consist essentially of, essentially consist of or consist of the components as described herein. For example, the aluminum alloy composition that may consist essentially of, essentially consist of or consist of: silicon (Si) in an amount of about 9.6 to 12.0 wt %; magnesium (Mg) in an amount of about 1.5 to 3.0 wt %; zinc (Zn) in an amount of about 3.0 to 6.0 wt %; iron (Fe) in an amount of about 1.3 wt % or less but greater than 0 wt %; manganese (Mn) in an amount of about 0.5 wt % or less but greater than 0 wt %; nickel (Ni) in an amount of about 0.5 wt % or less but greater than 0 wt %; tin (Sn) in an amount of about 0.2 wt % or less but greater than 0 wt %; and aluminum (Al) constituting the remaining balance of the aluminum alloy composition.

The aluminum alloy also may consist essentially of, essentially consist of or consist of silicon (Si) in an amount of about 9.6 to 12.0 wt %; magnesium (Mg) in an amount of about 1.5 to 3.0 wt %; zinc (Zn) in an amount of about 3.0 to 6.0 wt %; iron (Fe) in an amount of about 1.3 wt % or less but greater than 0 wt %; manganese (Mn) in an amount of about 0.5 wt % or less but greater than 0 wt %; nickel (Ni) in an amount of about 0.5 wt % or less but greater than 0 wt %; tin (Sn) in an amount of about 0.2 wt % or less but greater than 0 wt %; copper (Cu) in an amount of about 0.3 wt % or less; and aluminum (Al) constituting the remaining balance of the aluminum alloy composition.

In addition, the aluminum alloy also may consist essentially of, essentially consist of or consist of silicon (Si) in an amount of about 9.6 to 12.0 wt %; magnesium (Mg) in an amount of about 1.5 to 3.0 wt %; zinc (Zn) in an amount of about 3.0 to 6.0 wt %; iron (Fe) in an amount of about 1.3 wt % or less but greater than 0 wt %; manganese (Mn) in an amount of about 0.5 wt % or less but greater than 0 wt %; nickel (Ni) in an amount of about 0.5 wt % or less but greater than 0 wt %; tin (Sn) in an amount of about 0.2 wt % or less but greater than 0 wt %; titanium (Ti) in an amount of about 0.3 wt % or less; and aluminum (Al) constituting the remaining balance of the aluminum alloy composition.

In another aspect, provided is a method of heat treating an aluminum alloy composition for die casting. The method may comprise: preparing, by a solution treatment, a solution-treated aluminum alloy from an aluminum alloy composition that may be manufactured by die casting; primary aging the solution-treated aluminum alloy so as to form an $MgZn_2$ precipitate; and secondary aging the aluminum alloy having the $MgZn_2$ precipitate so as to form an $Mg_2Si$ precipitate.

The term "solution treatment" as used herein, refers to a heating or heat treating an alloy and alloy components thereof, which is followed by a rapid cooling to hold the alloy components in a form of a solid solution, in which a portion the alloy components can be uniformly distributed and mixed within the crystal lattice of the major component. For example, during the solution treatment, the aluminum alloy of the present application may be partially melt and some minor components may be in a dissolved state or uniformly distributed state in aluminum component.

The primary aging suitably may be performed at a temperature of about 110 to 130° C. for about 10 to 24 hours.

The secondary aging suitably may be performed at a temperature of about 160 to 180° C. for about 3 to 6 hours.

The aluminum alloy may include: silicon (Si) in an amount of about 9.6 to 12.0 wt %; magnesium (Mg) in an amount of about 1.5 to 3.0 wt %; zinc (Zn) in an amount of about 3.0 to 6.0 wt %; iron (Fe) in an amount of about 1.3 wt % or less but greater than 0 wt %; manganese (Mn) in an amount of about 0.5 wt % or less but greater than 0 wt %; nickel (Ni) in an amount of about 0.5 wt % or less but greater than 0 wt %; tin (Sn) in an amount of about 0.2 wt % or less but greater than 0 wt %; copper (Cu) in an amount of about 0.3 wt % or less; and aluminum (Al) constituting the remaining balance of the aluminum alloy composition.

In addition, the aluminum alloy further comprises at least one from copper (Cu) in an amount of about 0.3 wt % or less and tin (Ti) in an amount of about 0.3 wt % or less, based on the total weight of the aluminum alloy.

Still provided is a vehicle that may comprise the aluminum alloy composition as described herein.

Other aspects of the present invention are disclosed infra.

According to various exemplary embodiments of the present invention, the inclusion of Cu may be maximally inhibited, the amounts of Mg and Zn may be optimally set, and heat treatment conditions may be optimized so as to be adapted for an alloy composition, thus increasing strength while ensuring castability similar to that of conventional ADC10 and A380 alloys.

Also, castability equal to or greater than the conventional ADC10 and A380 alloys may be obtained, conventional molds and systems may be applied without change, and the production yield may be maintained at the same level.

In addition, the effects of impurities such as Fe on the properties of the alloy may be reduced such that the alloy may be recyclable.

BRIEF DESCRIPTION OF THE DRAWINGS

The above and other features and advantages of the present invention will be more clearly understood from the following detailed description taken in conjunction with the accompanying drawings, in which.

DESCRIPTION OF SPECIFIC EMBODIMENTS

Figure 1:
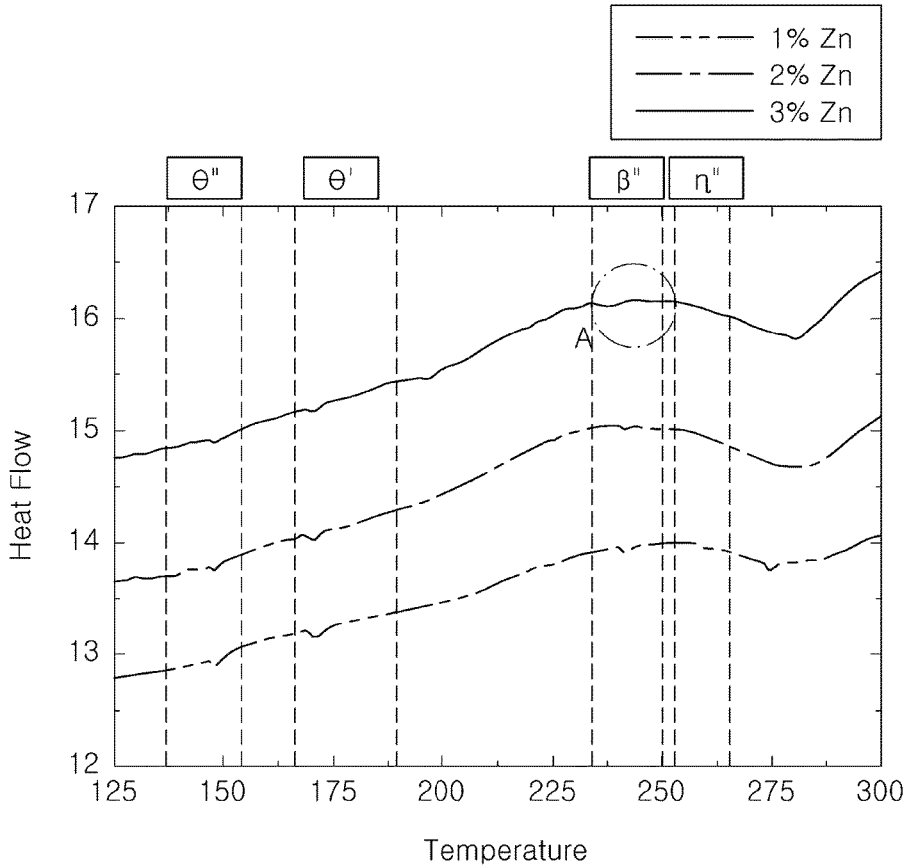
FIG. 1 illustrates results of differential scanning calorimetry (DSC) of precipitates that are formed when an A380 alloy is added with Zn in amounts of 1, 2 and 3 wt %.

The terminology used herein is for the purpose of describing particular exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Hereinafter, a detailed description will be given of embodiments of the present invention with reference to the appended drawings. However, the present invention is not limited to the following embodiments, which may be changed in various embodiments. These embodiments are provided to complete the disclosure of the present invention, and to fully describe the present invention to those skilled in the art.

According to the present invention, an aluminum alloy for die casting suitably may include a precipitation strengthening phase to improve strength through heat treatment for high-pressure die casting while retaining the advantages of conventional ADC10 and A380 alloys.

In order to obtain the alloy characteristics required for a die-casting process according to the present invention, the amounts of iron (Fe), manganese (Mn), nickel (Ni), tin (Sn), and titanium (Ti) may be maintained similar to those of corresponding components in the conventional ADC10 alloy or A380 alloy, and the amounts of other alloy components may be suitably adjusted to maximize the precipitation strengthening effect. Particularly, in the exemplary aluminum alloys of the present invention, silicon (Si), copper (Cu), magnesium (Mg) and zinc (Zn) may be main components used for improving strength by precipitation thereof, and may be formed into precipitates such as $Al_2Cu$, $Mg_2Si$ and $MgZn_2$.

For example, according to an exemplary embodiment of the present invention, the aluminum alloy for die casting may comprise silicon (Si) in an amount of about 9.6 to 12.0 wt %; magnesium (Mg) in an amount of about 1.5 to 3.0 wt %; zinc (Zn) in an amount of about 3.0 to 6.0 wt %; iron (Fe) in an amount of about 1.3 wt % or less but greater than 0 wt %; manganese (Mn) in an amount of about 0.5 wt % or less but greater than 0 wt %; nickel (Ni) in an amount of about 0.5 wt % or less but greater than 0 wt %; tin (Sn) in an amount of about 0.2 wt % or less but greater than 0 wt %; and aluminum (Al) constituting the remaining balance of the aluminum alloy composition. In order to improve the heat treatment effect, preferably, an amount of about 0.3 wt % or less of Ti may be further included. Alternatively, an amount of Cu, which may be inevitably mixed therewith, may be included but limited to about 0.3 wt % or less.

In the present invention, the reason why the alloy components and the amounts thereof are limited is as follows. Unless otherwise stated, "%", when representing the unit of the amount of the component, refers to "wt %".

Silicon (Si) suitably may be included in an amount of about 9.6 to 12.0%. Si as used herein may improve castability and form a precipitate, such that the Si content may be included in the maximum amount at a temperature equal to or less than a eutectic point. Accordingly, the amount of Si suitably may range from about 9.6% to about 12.0%.

Magnesium (Mg) suitably may be included in an amount of about 1.5 to 3.0%. Mg may form a precipitate, however, when added greater than the predetermined amount, for example, greater than about 3.0%, castability and properties may deteriorate and inclusions may be generated due to oxidation. Accordingly, the amount of Mg suitably may range from about 1.5% to about 3.0%.

Zinc (Zn) suitably may be included in an amount of about 3.0 to 6.0%. Zn as used herein may form precipitate of strengthening phase that may replace a Cu-based strengthening phase in the present invention, and thus a Zn—Mg-based strengthening phase may be precipitated.

In particular, the amount of copper (Cu) may be limited to about 0.3% or less. Typically, Cu in an aluminum alloy for die casting may be used as a precipitation strengthening element, and thus plays a role in strengthening the aluminum alloy. Accordingly, the alloy may be designed so as to include Cu in an amount of about 4.0% which is the solid solution limit. The simple addition of Cu in an amount equal to or greater than the solid solution limit in order to increase the heat-treatment strengthening effect may cause problems since Cu may not be dissolved in Al and thus there may not be sufficient improvement to the properties, and side effects may occur due to segregation. Accordingly, since the strength of the alloy cannot be increased as desired by the use of the Cu-based strengthening phase, Cu suitably may be included in a minimum amount required to precipitate a Zn-based strengthening phase. Cu may be inevitably mixed upon forming the aluminum alloy, and thus the amount thereof may be limited to about 1% or less, and preferably about 0.3% or less.

In addition, a method of heat treating the aluminum alloy for die casting according to an exemplary embodiment of the present invention is suitable for heat treatment of the alloy having the above components in the above amounts, the method may include: preparing, by a solution treatment, a solution-treated aluminum alloy from an aluminum alloy that may be manufactured through die casting; primary aging the solution-treated aluminum alloy so as to form a $MgZn_2$ precipitate; and secondary aging the aluminum alloy having the $MgZn_2$ precipitate so as to form an $Mg_2Si$ precipitate.

Preferably, the primary aging may be performed at a temperature of about 110 to 130° C. for about 10 to 24 hours, and the secondary aging may be performed at a temperature of about 160 to 180° C. for about 3 to 6 hours.

The reason why the amounts of silicon (Si), copper (Cu), magnesium (Mg) and zinc (Zn) may be limited and the reason why the aging process may be limited are described below.

In the present embodiment, in order to increase the strength of the alloy as desired while decreasing the amount of Cu compared to the ADC10 and A380 alloys, heat treatment for $MgZn_2$, which is an Mg—Zn-based strengthening phase, was performed, and the amounts of Mg and Zn in the conventional A380 alloy were adjusted.

TEST EXAMPLE 1

The precipitates resulting from adding the A380 alloy with Zn in amounts of 1, 2 and 3% were analyzed using DSC. The results are illustrated in FIG. 1 and the following Table 1.

As illustrated in FIG. 1 and Table 1, $Al_2Cu$ and $Mg_2Si$ precipitates were observed when Zn was added in an amount of 1%, but no Zn phase was observed. Even when Zn was added in an amount of 3%, the Zn phase was not observed, and the $Mg_2Si$ phase was decreased (the dotted line A). These results are deemed to be because the amount of dissolved Mg is decreased due to the solid solution of excess Zn or because an additional composite appears in lieu of $Mg_2Si$.

TABLE 1

| | Temp. on DSC (° C.) | | Heat flow (mW/g) | | |
|---|---|---|---|---|---|
| Intermediate precipitate | Phase appearance Temperature range | Measurement Temperature | Zn 1 wt. % | Zn 2 wt. % | Zn 3 wt. % |
| θ''($Al_2Cu$) | 140~150 | 147 | 63 | 42 | 35 |
| θ'($Al_2Cu$) | 170~190 | 170 | 82 | 71 | 67 |
| β''($Mg_2Si$) | 230~250 | 241 | 61 | 55 | 21 |
| η''($MgZn_2$) | 250~260 | — | | No peak | |

Thus, the strengthening effect could not be obtained through the simple addition of Zn. Also, the addition of Zn resulted in a reduction in $Mg_2Si$, which is a conventional strengthening phase, rather than the production of the desired $MgZn_2$ precipitate.

In addition, the properties of the A380 alloy were analyzed when added with Zn in amounts of 1, and 2 and 3%. The results are illustrated in FIG. 2.

Figure 2:
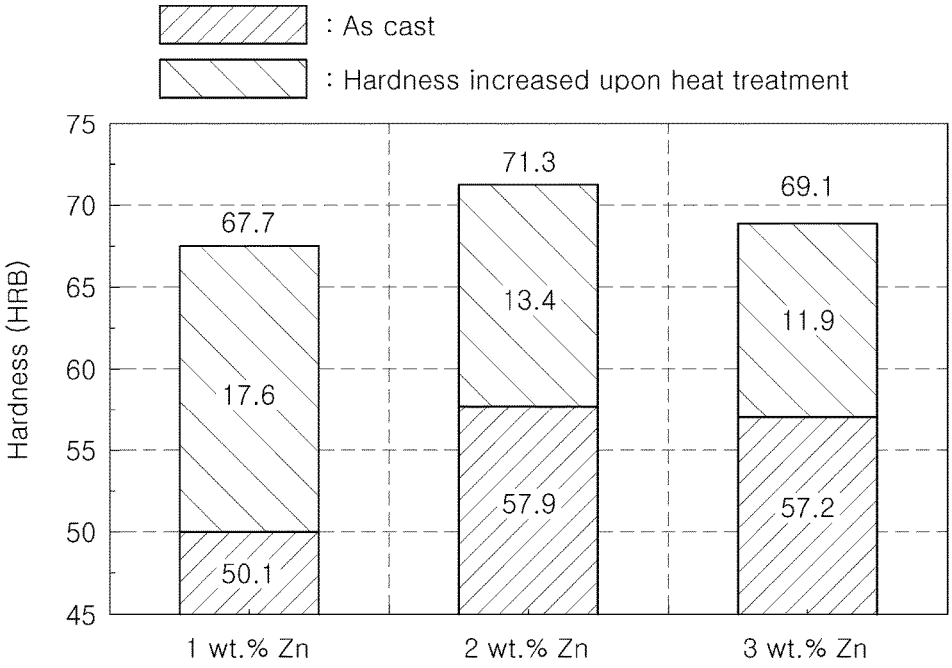
FIG. 2 illustrates the results of analysis of the properties of an A380 alloy when added with Zn in amounts of 1, 2 and 3 wt %.

As shown in FIG. 2, strength (hardness) was not increased as desired when Zn was added. When the amount of Zn was greater than 2%, hardness was decreased slightly. Accordingly, when Zn is present in a solid solution phase, and thus when the dissolved amount thereof is increased, the dissolved amounts of other alloying elements may be decreased.

The reason why Zn is not present in the form of the $MgZn_2$ precipitate is that Mg, existing in a relatively small amount, may be consumed to thus produce $Mg_2Si$ upon solidification in the presence of Si. In this case, when Mg is provided in a sufficient amount, the $Mg_2Si$ phase may be oversaturated and that the remaining amount thereof may be formed into an $MgZn_2$ phase.

Under this assumption, even when the amounts of both Zn and Mg were increased, heat treatment properties were not improved as desired.

TEST EXAMPLE 2

In order to determine the reason why desired heat treatment properties were not obtained despite the increase in the amounts of Zn and Mg in Test Example 1, phase analysis programs were performed. The conventional ADC12 alloy was phase analyzed. The results are illustrated in FIGS. 3 and 4.

Figure 3:
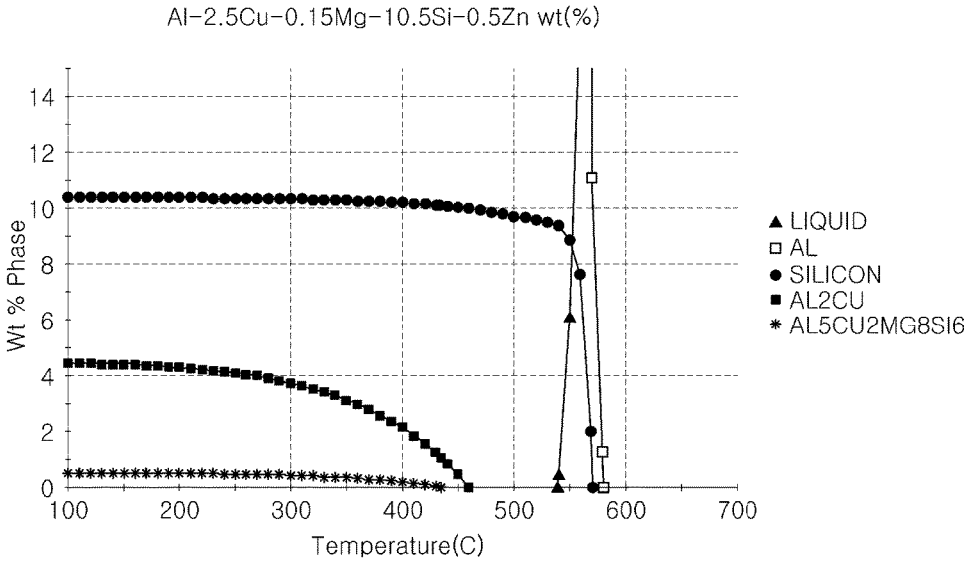
FIG. 3 illustrates results of phase analysis of an ADC12 alloy (Al-2.5Cu-0.15Mg-10.5Si-0.5Zn)
Figure 4:
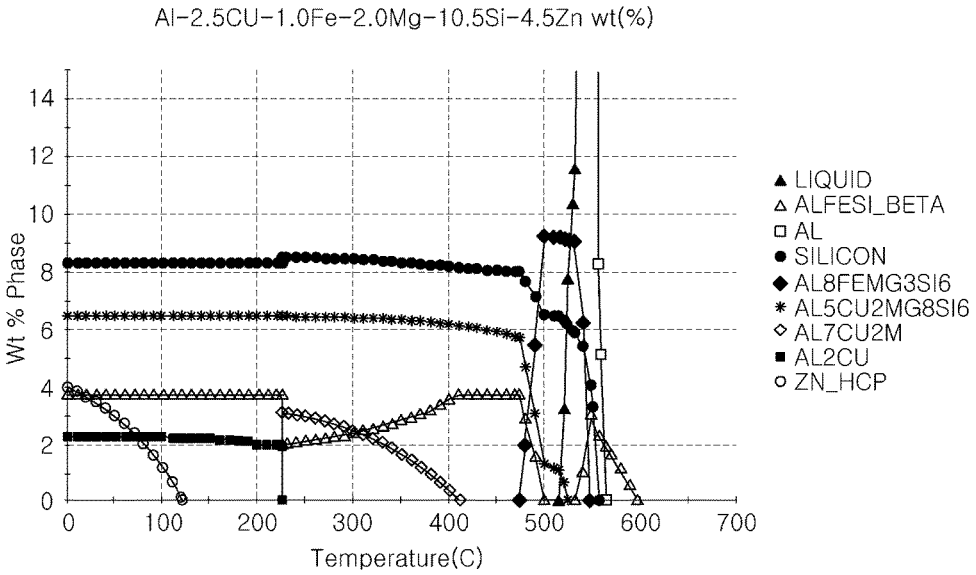
FIG. 4 illustrates results of phase analysis of an ADC12 alloy (Al-2.5Cu-1.0Fe-2.0Mg-10.5Si-4.5Zn)

FIG. 3 illustrates the results of phase analysis when Fe is not added, and FIG. 4 illustrates the results of phase analysis when Fe is added.

As illustrated in FIG. 3, the strengthening phase upon heat treatment of ADC12 was mainly considered to be $Al_2Cu$. Furthermore, the precipitate began to be formed at a temperature of about 460° C., which indicated that $Al_2Cu$ was dissolved under conventionally known solution treatment conditions of a temperature of 480 to 520° C. The formation of the Mg strengthening phase was hindered due to the production of a composite in the presence of Cu and Si. As shown in FIG. 4, in the presence of Fe, the Mg strengthening phase was formed into a composite through the reaction with Fe, making it difficult to attain heat treatment effects even in the case of die casting products to be quenched.

Therefore, when the amounts of both Zn and Mg are increased, the strength may be improved due to $Al_2Cu$ and strength may be increased upon heat treatment. In the case of $Mg_2Si$, another strengthening phase, it was formed into a Si—Cu—Mg composite and was consumed by a Fe composite, making it difficult to contribute to an increase in strength upon heat treatment. Also, Mg was consumed even by the Fe—Mg—Si composite, which corresponds to the results of evaluating the actual optimal aging temperature. Therefore, the strength appeared to be maximally increased at a temperature of 160 to 180° C., corresponding to the aging temperature of the Cu phase.

TEST EXAMPLE 3

Figure 5:
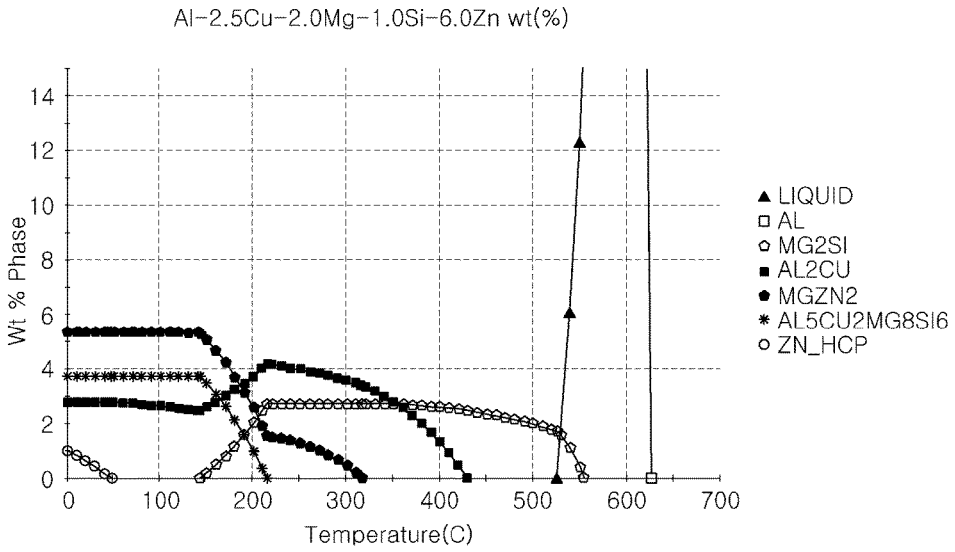
FIG. 5 illustrates results of phase analysis of an A7075 alloy (Al-2.5Cu-2.0Mg-1.0Si-6.0Zn)
Figure 6:
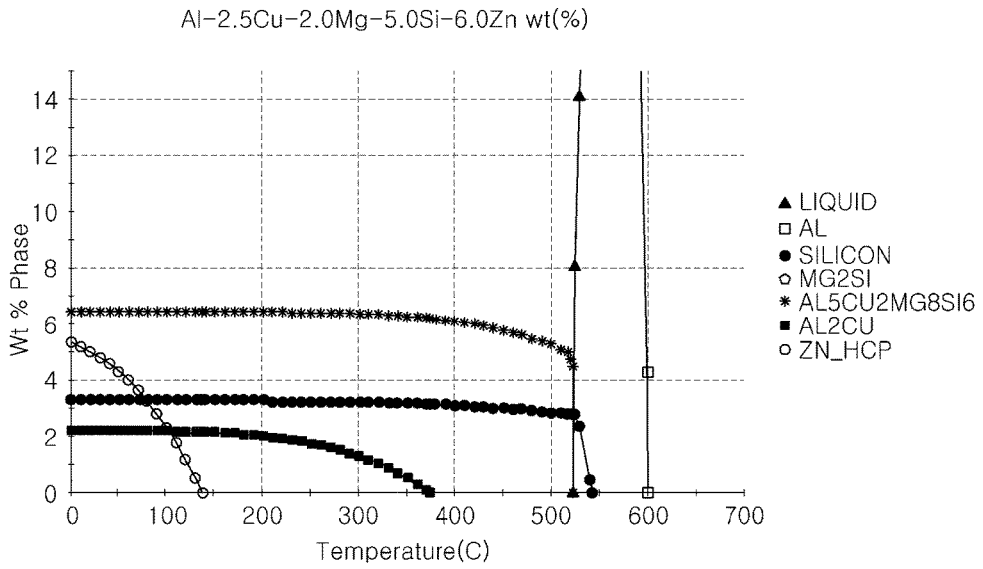
FIG. 6 illustrates results of phase analysis of an A7075 alloy (Al-2.5Cu-2.0Mg-5.0Si-6.0Zn)

The results of phase analysis of the A7075 alloy, which is a typical $MgZn_2$ alloy, are illustrated in FIGS. 5 and 6.

FIG. 5 illustrates the results of phase analysis of the A7075 alloy, and FIG. 6 illustrates the results of addition of excess Si to the casting material.

The A7075 alloy was produced in the sequence of $Mg_2Si \rightarrow Al_2Cu \rightarrow MgZn_2 \rightarrow$ Al—Cu—Mg—Si composite, and the $MgZn_2$ phase was produced in the greatest amount. When excess Si was added, no strengthening phases other than $Al_2Cu$ was formed, and Zn was present only in a solid solution phase, because the Si—Cu—Mg composite appears upon addition of excess Si.

TEST EXAMPLE 4

Figure 7:
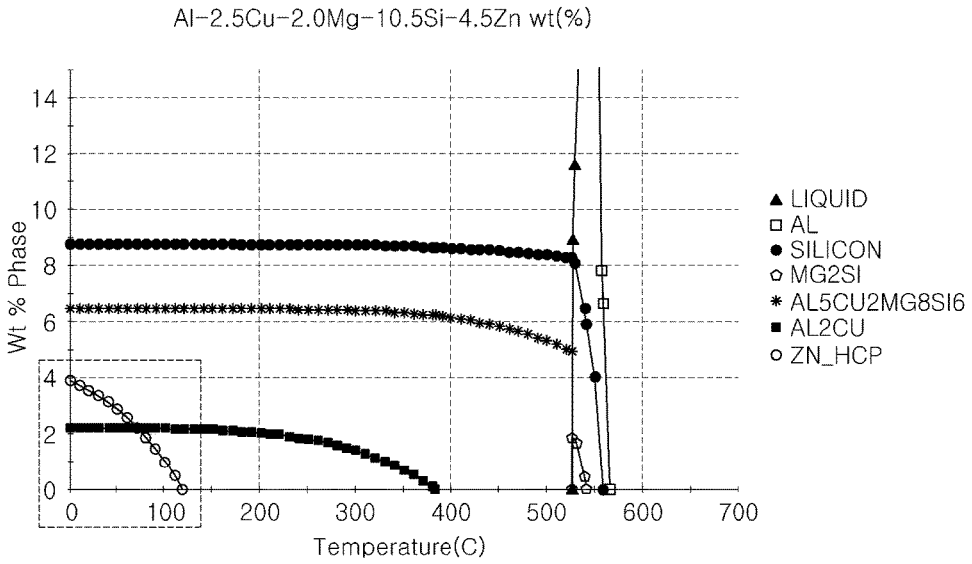
FIG. 7 illustrates results of phase analysis of an A380 alloy (Al-2.5Cu-2.0Mg-10.5Si-4.5Zn)
Figure 8:
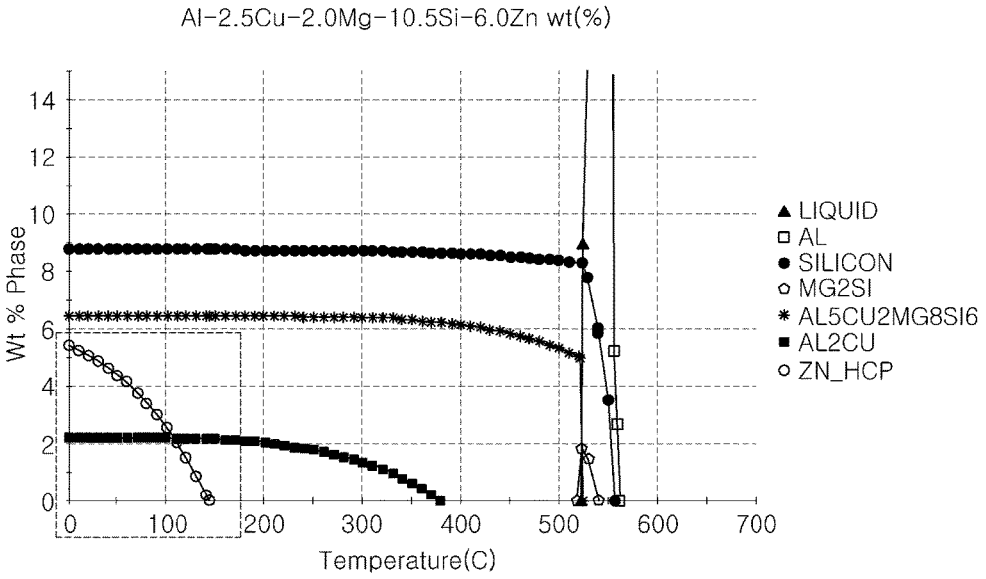
FIG. 8 illustrates results of phase analysis of the A380 alloy (Al-2.5Cu-2.0Mg-10.5Si-6.0Zn)

The results of phase analysis of the alloys developed by adding the conventional A380 alloy with Zn and Mg are illustrated in FIGS. 7 and 8.

FIG. 7 illustrates the results of addition of 4.5% of Zn, and FIG. 8 illustrates the results of addition of 6.0% of Zn.

Like Test Example 2, $Mg_2Si$ was consumed after the appearance of the composite ($Al_5Cu_2Mg_8Si_6$), and $Al_2Cu$ began to be produced at a temperature of 400° C. or less. The resultant Zn_HCP may be a solid solution phase, and $MgZn_2$ may not be formed.

Thus, when Zn and Mg were excessively added, the $MgZn_2$ strengthening phase of interest was not formed, and only the solid solution phase was formed, which matches the results of evaluation of the precipitates using DSC. The addition of the A380 alloy with Zn is unsuitable for enhancing the strength, which may be due to appearance of the Si—Cu—Mg composite ($Al_5Cu_2Mg_8Si_6$) in the presence of Si, as shown in the results of phase analysis of the A7075 alloy.

In order to develop the Zn-based die casting alloy for heat treatment, it may be essential to inhibit the production of the composite $Al_5Cu_2Mg_8Si_6$. This composite was produced at a temperature of about 500° C., and was known to be formed together with $Al_2Cu$. Hence, it may be important to inhibit the production of the composite through the control of the alloy components, rather than heat treatment conditions.

Thus, in the present invention, the production of the composite may be inhibited by removing any one of the composite elements.

TEST EXAMPLE 5

In order to evaluate changes in the other compounds depending on the amount of Si, the amount of Si in the Al-2.5Cu-2.0Mg—(Si)-5.0Zn alloy was changed. The results of phase analysis are illustrated in FIG. 9.

Figure 9:
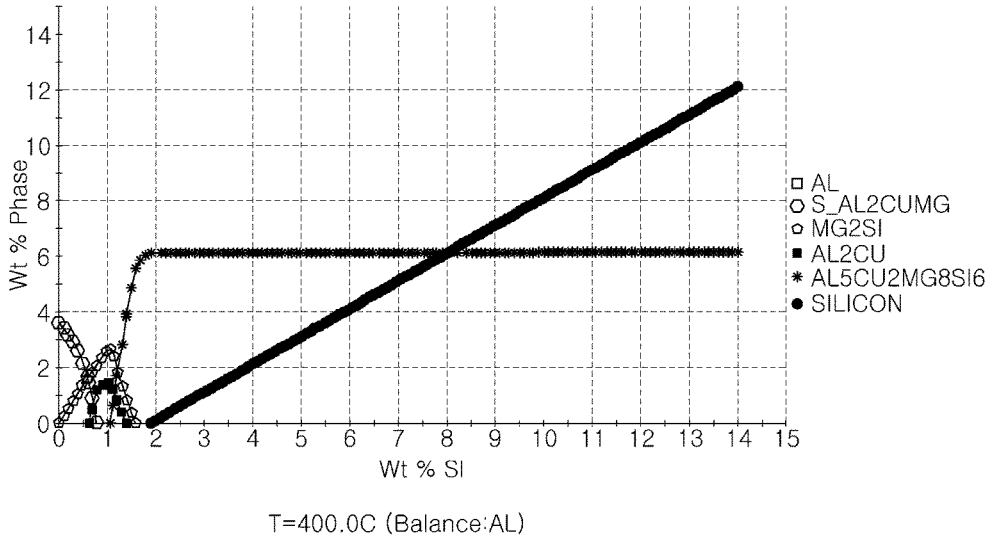
FIG. 9 illustrates test results of an exemplary Al—Cu—Mg—Si—Zn alloy according to an exemplary embodiment of the present invention depending on changes in the amount of Si.

As illustrated in FIG. 9, when the amount of Si was 1% or greater, the composite ($Al_5Cu_2Mg_8Si_6$) appeared. When the amount of Si was 1.85% or greater, Mg and Cu were consumed to thus produce the composite ($Al_5Cu_2Mg_8Si_6$), rather than the formation of $Mg_2Si$ and $Al_2Cu$. Based on the above results, Si may essentially be contained in a predetermined amount in the casting alloy, and thus, production of the composite may be inhibited through the control of the Si component.

Also, Mg may be the component of the main strengthening phase in the present invention, and thus, minimizing the amount of Cu, which is the remaining component, may be considered as appropriate in order to inhibit the production of the composite.

TEST EXAMPLE 6

Figure 10:
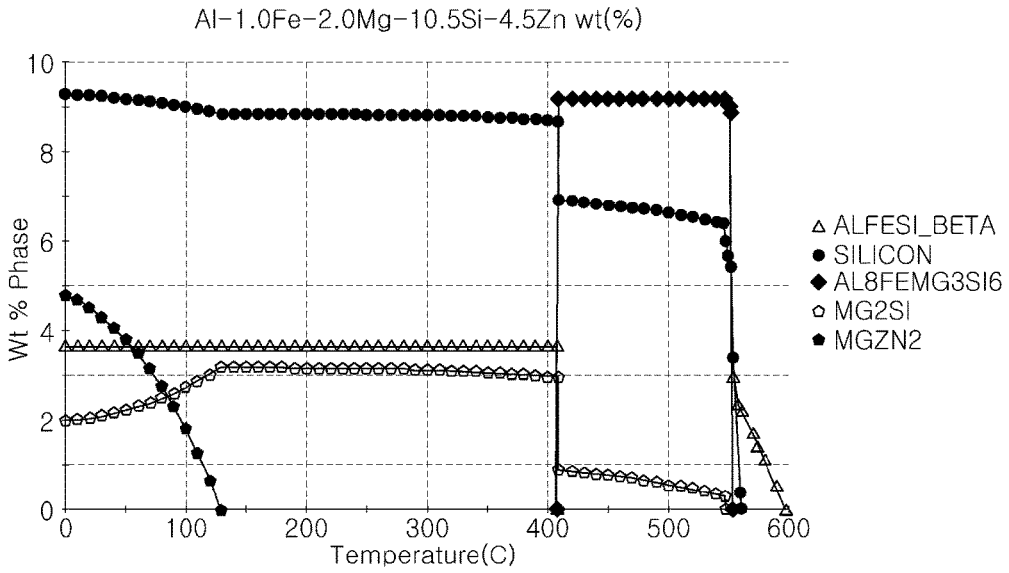
FIG. 10 illustrates results of phase analysis for producing a heat-treatment strengthening phase (Al—Cu—Mg—Si)

FIG. 10 illustrates the results of phase analysis in the Cu-free alloy, containing Si in the same amount as in the ADC12 alloy and Zn and Mg in respective amounts of 4.5 and 2.0 wt %, in order to form the heat-treatment strengthening phase (Al—Cu—Mg—Si).

As illustrated in FIG. 10, $MgZn_2$ and $Mg_2Si$ were produced in large amounts, and Zn was not dissolved, but was present only in a precipitation strengthening phase. Furthermore, $MgZn_2$ was present in a stable phase at a temperature of about 130° C.

The alloy was configured to include Fe because another composite Al—Fe—Si—Mg was likely to result. Based on the analysis results, however, since the composite had a stable phase only at a temperature of 400° C. or greater, the amount of Mg that was consumed was not large upon actual die casting.

TEST EXAMPLE 7

Figure 11:
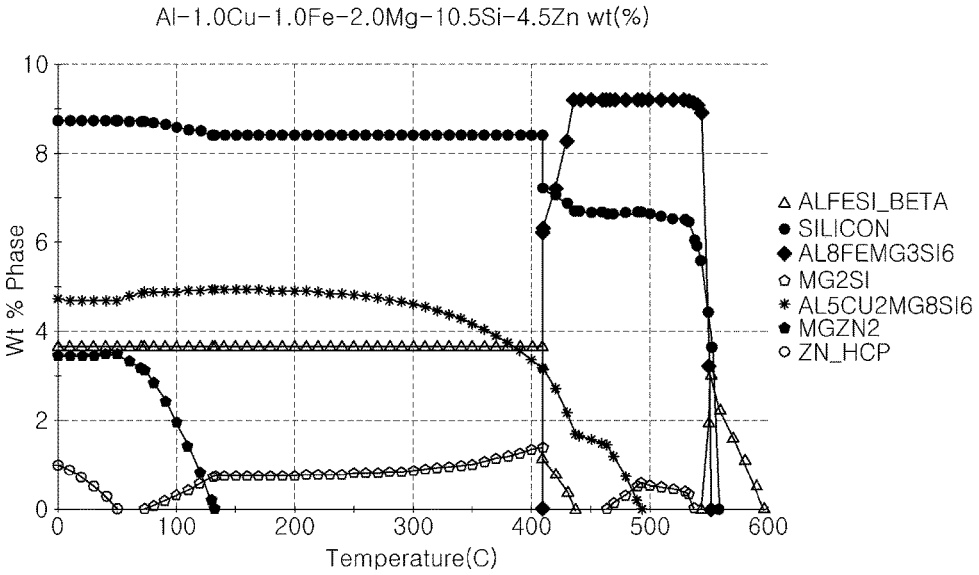
FIG. 11 illustrates results of phase analysis of an exemplary alloy according to an exemplary embodiment of the present invention depending on the amount of Cu.
Figure 12:
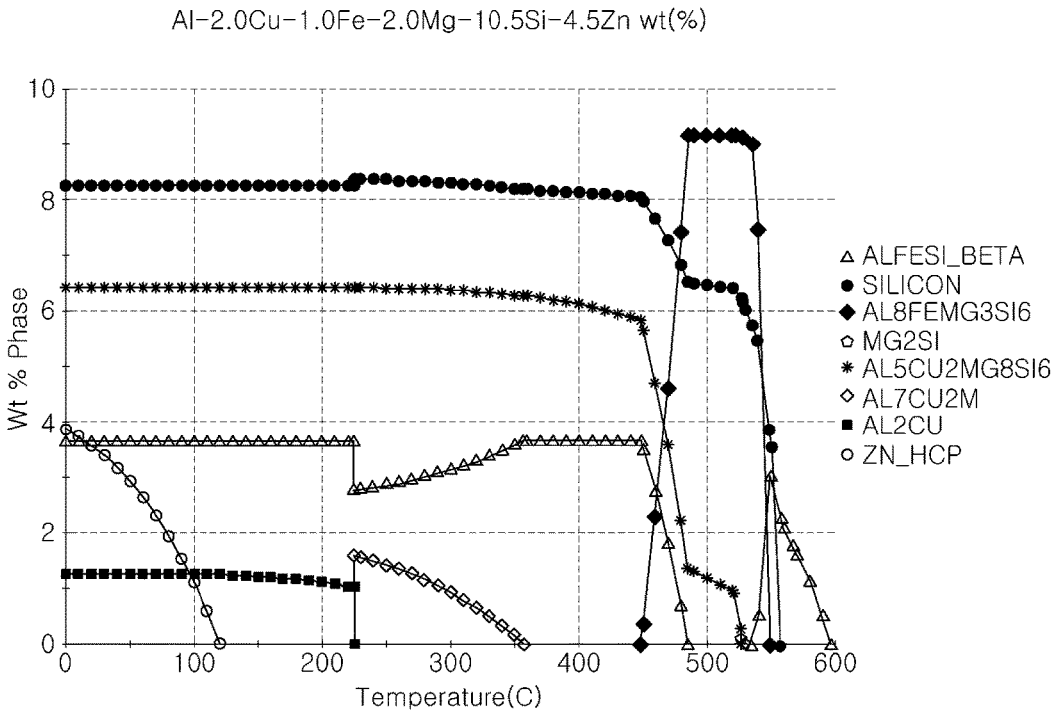
FIG. 12 illustrates results of phase analysis of an exemplary alloy according to an exemplary embodiment of the present invention depending on the amount of Cu.

The results of phase analysis when Cu is added in amounts of 1% and 2% are illustrated in FIGS. 11 and 12.

Figure 13:
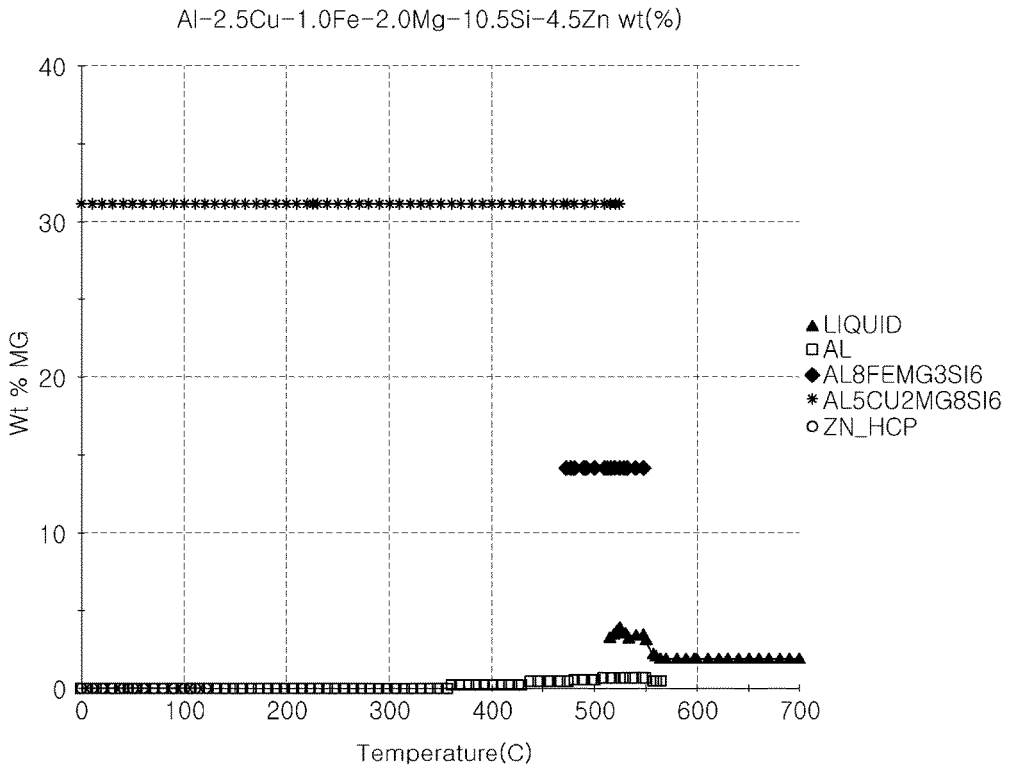
FIG. 13 illustrates changes in the strengthening phase attributable to Mg depending on the amount of Cu in an exemplary alloy (Al-2.5Cu-1.0Fe-2.0Mg-10.5Si-4.5Zn) of the present invention.

FIG. 11 illustrates the results of addition of 1% of Cu, and FIG. 13 illustrates the results of addition of 2% of Cu.

As shown in FIG. 12, when the amount of Cu was added in an amount of 1%, the $Al_5Cu_2Mg_8Si_6$ composite was shown in a predetermined amount (less than 5%), and $MgZn_2$ was present in a stable phase, and some solid solution phase appeared.

As shown in FIG. 12, when the amount of Cu was 2%, the $Al_5Cu_2Mg_8Si_6$ composite was produced in an amount of 6% or greater, and the $MgZn_2$ phase was not produced. Accordingly, the amount of Cu in the developed alloy may be limited to 1% or less.

TEST EXAMPLE 8

By comparing the amounts of Mg distributed in each alloy, whether any phase was produced by Mg was analyzed. The results are illustrated in FIGS. 13 and 14.

As illustrated in FIG. 13, when Cu was present in an amount of 2.0 wt % or greater, Mg was consumed only to produce the Al—Cu—Mg—Si composite and the strengthening phases were not present, and Zn was present in a solid solution phase.

Figure 14:
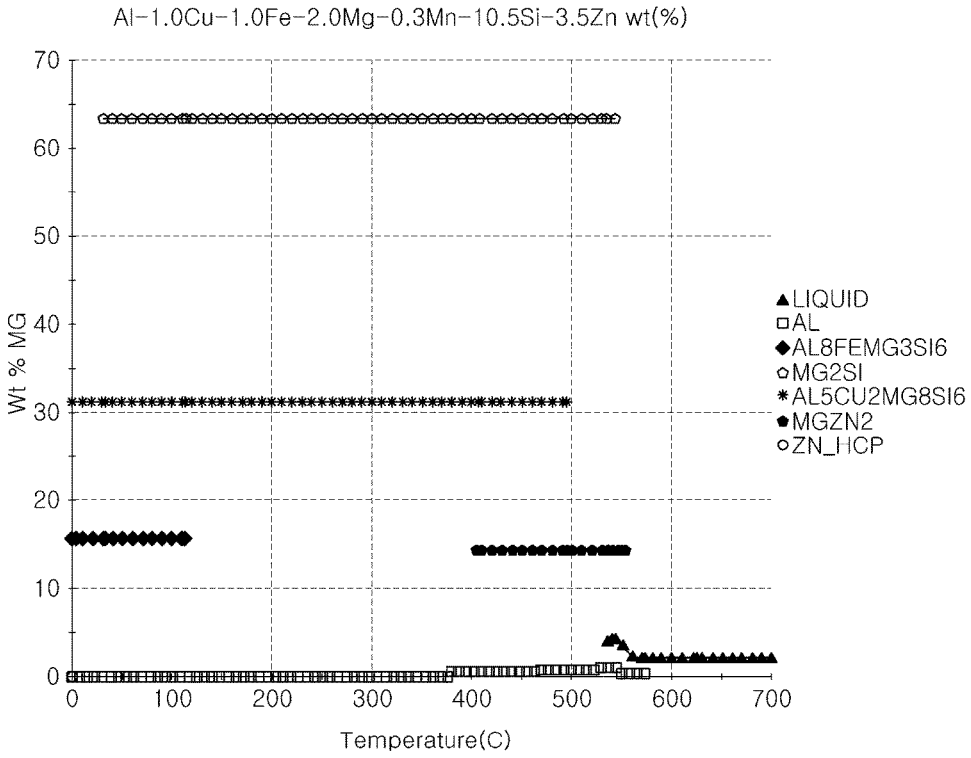
FIG. 14 illustrates changes in the strengthening phase attributable to Mg depending on the amount of Cu in an exemplary alloy (Al-1.0Cu-1.0Fe-2.0Mg-0.3Mn-10.5Si-3.5Zn) of the present invention.

As illustrated in FIG. 14, when Cu was present in an amount of 1%, Mg was partially consumed to thus produce an Al—Cu—Mg—Si composite, but contributed to the formation of strengthening phases, and the Zn solid solution phase was not readily apparent.

The components and amounts of the conventional alloys for die casting and the alloy for die casting according to Example of the present invention are compared and shown in Table 2 below.

TABLE 2

| Alloy | | Si | Cu | Mg | Zn | Fe | Mn | Ni | Sn | Ti |
|---|---|---|---|---|---|---|---|---|---|---|
| ADC10 | min. | 7.5 | 2 | — | — | — | — | — | — | — |
| | max. | 9.5 | 4 | 0.3 | 1 | 1.3 | 0.5 | 0.5 | 0.2 | 0.3 |
| ADC12 | min. | 9.6 | 1.5 | — | — | — | — | — | — | — |
| | max. | 12 | 3.5 | 0.3 | 1 | 1.3 | 0.5 | 0.5 | 0.2 | 0.3 |
| A380 | min. | 7.5 | 3 | — | — | — | — | — | — | — |
| | max. | 9.5 | 4 | 0.1 | 3 | 1.3 | 0.5 | 0.5 | 0.35 | — |
| A7075 | min. | — | 1.2 | 2.1 | 5.1 | — | — | | | — |
| | max. | 0.4 | 2 | 2.9 | 6.1 | 0.5 | 0.3 | | | 0.2 |
| Example | min. | 9.6 | — | 1.5 | 3 | — | — | — | — | — |
| | max. | 12 | 0.3 | 3 | 6 | 1.3 | 0.5 | 0.5 | 0.2 | 0.3 |

The alloy of Example was composed of Zn and Mg in amounts of 3.0 to 6.0% and 1.5 to 3.0%, respectively, in order to enhance strength. As such, to inhibit the formation of the composite that hinders the production of the main strengthening phases $MgZn_2$ and $Mg_2Si$, the amount of Cu was limited to 0.3% or less, and, to maximize heat treatment effects, a fining agent Ti was added in an amount of 0.1 to 0.5%.

Furthermore, in order to ensure castability for die casting, the amount of Si was maximally ensured at a eutectic point or less, and the amount of Fe was maintained the same as in conventional alloys.

The properties of the alloy may be determined by the amount of Zn+Mg. When the amount of Zn+Mg is about 9% or greater, strength and heat treatment effects may be maximized, but also, stress corrosion may increase and casting moldability may be decreased. On the other hand, when the amount of Zn+Mg is within a range of about 6 to 8%, high strength may be maintained and side effects such as corrosion, molding, and the like may be reduced. Accordingly, these components are used in the above amount range. As such, when the Zn/Mg ratio is 2.0 or greater, $MgZn_2$ may be suitably formed. In the case where the Zn/Mg ratio is less than the above value, $Mg_3Zn_3Al_2$ is formed. Accordingly, the Zn/Mg ratio in the developed alloy may be at about 2.0 or greater.

Iron (Fe) does not cause properties to significantly decrease when the amount thereof is about 1.3% or less, corresponding to the typical recycling alloy level, and thus, the level of the impurities may be controlled in conventional typical die casting alloy, together with Mn and Sn.

Meanwhile, the two strengthening phases that were produced may have different temperatures at which individual precipitates are produced, such that maximum strength upon heat treatment under the same conditions may not be sufficiently obtained. In the present embodiment, $MgZn_2$, having a low precipitation temperature, was first precipitated, and then $Mg_2Si$ was formed, whereby individual precipitates were precipitated maximally in the form of a coherent phase in order to increase strength.

In the primary aging step, the temperature may be maintained in the range of about 110 to 130° C. for about 10 to 24 hours, corresponding to typical 7000 series aluminum alloy conditions, and secondary aging may be performed at a temperature of about 160 to 180° C. for 3 to 6 hours. Upon primary aging, the precipitated $MgZn_2$ may be converted into an incoherent phase that is stable under secondary aging temperature conditions. When the secondary aging time is greater than the predetermined time, for example, greater than about 6 hours, the properties may deteriorate. Also, during the primary aging, some $Mg_2Si$ may be precipitated, and thus the secondary aging time may be preferably controlled to be less than a typical level.

The properties of the alloys according to the present embodiment were evaluated as follows.

Using aluminum alloys having the following compositions of Table 3, tensile samples were manufactured using a high-vacuum die casting system and then subjected to solution treatment at about 500° C. or greater for 6 hours or greater in order to maximize the aging temperature, after which primary aging was performed at a temperature of about 120° C. for 12 hours to precipitate $MgZn_2$ and secondary aging was conducted at 175° C. for 3 hours to precipitate $Mg_2Si$. The properties of the manufactured samples were evaluated. The results are shown in Table 4 below.

TABLE 3

| Component (wt %) | Si | Cu | Mg | Zn | Fe | Mn | Ti |
|---|---|---|---|---|---|---|---|
| #1 | 10.5 | 0.24 | 2.02 | 4.1 | 0.88 | 0.35 | — |
| #2 | 10.1 | 0.22 | 1.98 | 4.08 | 0.78 | 0.35 | 0.2 |

TABLE 4

| No. | YS (MPa) | UTS (MPa) | EL (%) |
|---|---|---|---|
| #1 | 332 | 416 | 2.93 |
| #2 | 336 | 415 | 3.13 |
| ADC12 | 170 | 250 | 1.2 |

As shown in Table 3, compared to conventional ADC12, yield strength was increased about two times, and tensile strength was increased about 1.6 times, and further, elongation was increased about 2.5 times.

Using Sample #1, the properties of alloys were tested under heat treatment conditions. The heat treatment conditions and results are shown in Table 5 below.

TABLE 5

| Heat treatment conditions | | | Tensile | | |
|---|---|---|---|---|---|
| Type | Solution treatment | Aging | strength (MPa) | Elongation (%) | Hardness (HB) |
| T6 | 500° C. 6 hours | 110° C. 12 hours + | 395 | 2.51 | 120 |
| | 520° C. 6 hours | 180° C. 3 hours | 424 | 2.98 | 118 |
| | 500° C. 4 hours | | 398 | 1.49 | 115 |
| | 520° C. 4 hours | | 421 | 2.56 | 118 |
| T5 | 530° C. 6 hours | 110° C. 10 hours + 180° C. 6 hours | 401 | 3.01 | 113 |
| | | 110° C. 10 hours + 180° C. 3 hours | 426 | 2.36 | 125 |

TABLE 5-continued

| Heat treatment conditions | | | Tensile | | |
|---|---|---|---|---|---|
| Type | Solution treatment | Aging | strength (MPa) | Elongation (%) | Hardness (HB) |
| | | 120° C. 20 hours + 160° C. 6 hours | 411 | 1.78 | 122 |
| | | 120° C. 20 hours + 160° C. 3 hours | 412 | 2.31 | 119 |

As shown in Table 5, the longer the primary aging time, the lower the secondary aging effects. The maximum properties were exhibited under aging conditions at a temperature of 110° C. for 10 hours followed by a condition at a temperature of 180° C. for 3 hours. Thus, heat treatment conditions may suitably be applied according to the end use within the temperature and time ranges of primary aging and secondary aging.

Although the various exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An aluminum alloy composition, comprising:
silicon (Si) in an amount of about 9.6 to 12.0 wt %;
magnesium (Mg) in an amount of about 1.5 to 3.0 wt %;
zinc (Zn) in an amount of about 3.0 to 6.0 wt %;
iron (Fe) in an amount of about 1.3 wt % or less but greater than 0 wt %;
manganese (Mn) in an amount of about 0.5 wt % or less but greater than 0 wt %;
nickel (Ni) in an amount of about 0.5 wt % or less but greater than 0 wt %;
tin (Sn) in an amount of about 0.2 wt % or less but greater than 0 wt %; and
aluminum (Al) constituting the remaining balance of the aluminum alloy composition,
all the wt % based on the total weight of the aluminum alloy composition,
wherein a sum of amounts of Mg and Zn is of about 6 to 8 wt %.

2. The aluminum alloy composition of claim 1, further comprising copper (Cu) in an amount of about 0.3 wt % or less based on the total weight of the aluminum alloy composition.

3. The aluminum alloy composition of claim 1, further comprising titanium (Ti) in an amount of about 0.3 wt % or less based on the total weight of the aluminum alloy composition.

4. The aluminum alloy composition of claim 1, further comprising copper (Cu) in an amount of about 0.3 wt % or less and titanium (Ti) in an amount of about 0.3 wt % or less, based on the total weight of the aluminum alloy composition.

5. The aluminum alloy composition of claim 1, wherein a ratio of Mg/Zn is about 2.0 or greater.

6. The aluminum alloy composition of claim 1, wherein the aluminum alloy has a yield strength of about 300 MPs or greater.

7. The aluminum alloy composition of claim 1, wherein the aluminum alloy has a tensile strength of about 350 MPs or greater.

8. The aluminum alloy composition of claim 1, wherein the aluminum alloy has an elongation of about 2% or greater.

9. The aluminum alloy composition of claim 1, consisting essentially of:

silicon (Si) in an amount of about 9.6 to 12.0 wt %;
magnesium (Mg) in an amount of about 1.5 to 3.0 wt %;
zinc (Zn) in an amount of about 3.0 to 6.0 wt %;
iron (Fe) in an amount of about 1.3 wt % or less but greater than 0 wt %;
manganese (Mn) in an amount of about 0.5 wt % or less but greater than 0 wt %;
nickel (Ni) in an amount of about 0.5 wt % or less but greater than 0 wt %;
tin (Sn) in an amount of about 0.2 wt % or less but greater than 0 wt %; and
aluminum (Al) constituting the remaining balance of the aluminum alloy composition,
all the wt % based on the total weight of the aluminum alloy composition.

10. The aluminum alloy composition of claim 1, consisting essentially of:

silicon (Si) in an amount of about 9.6 to 12.0 wt %;
magnesium (Mg) in an amount of about 1.5 to 3.0 wt %;
zinc (Zn) in an amount of about 3.0 to 6.0 wt %;
iron (Fe) in an amount of about 1.3 wt % or less but greater than 0 wt %;
manganese (Mn) in an amount of about 0.5 wt % or less but greater than 0 wt %;
nickel (Ni) in an amount of about 0.5 wt % or less but greater than 0 wt %;
tin (Sn) in an amount of about 0.2 wt % or less but greater than 0 wt %;
copper (Cu) in an amount of about 0.3 wt % or less and
aluminum (Al) constituting the remaining balance of the aluminum alloy composition,
all the wt % based on the total weight of the aluminum alloy composition.

11. The aluminum alloy composition of claim 1, consisting essentially of:

silicon (Si) in an amount of about 9.6 to 12.0 wt %;
magnesium (Mg) in an amount of about 1.5 to 3.0 wt %;
zinc (Zn) in an amount of about 3.0 to 6.0 wt %;
iron (Fe) in an amount of about 1.3 wt % or less but greater than 0 wt %;
manganese (Mn) in an amount of about 0.5 wt % or less but greater than 0 wt %;
nickel (Ni) in an amount of about 0.5 wt % or less but greater than 0 wt %;
tin (Sn) in an amount of about 0.2 wt % or less but greater than 0 wt %;
titanium (Ti) in an amount of about 0.3 wt % or less; and
aluminum (Al) constituting the remaining balance of the aluminum alloy composition,
all the wt % based on the total weight of the aluminum alloy composition.

12. The aluminum alloy composition of claim 1, consisting essentially of:

silicon (Si) in an amount of about 9.6 to 12.0 wt %;
magnesium (Mg) in an amount of about 1.5 to 3.0 wt %;
zinc (Zn) in an amount of about 3.0 to 6.0 wt %;
iron (Fe) in an amount of about 1.3 wt % or less but greater than 0 wt %;
manganese (Mn) in an amount of about 0.5 wt % or less but greater than 0 wt %;
nickel (Ni) in an amount of about 0.5 wt % or less but greater than 0 wt %;
tin (Sn) in an amount of about 0.2 wt % or less but greater than 0 wt %;
copper (Cu) in an amount of about 0.3 wt % or less;
titanium (Ti) in an amount of about 0.3 wt % or less; and
aluminum (Al) constituting the remaining balance of the aluminum alloy composition,
all the wt % based on the total weight of the aluminum alloy composition.

13. A method of heat treating an aluminum alloy for die casting, comprising:

preparing, by a solution treatment, a solution-treated aluminum alloy from an aluminum alloy that is manufactured via die casting;
primary aging the solution-treated aluminum alloy so as to form an $MgZn_2$ precipitate; and
secondary aging the aluminum alloy containing the $MgZn_2$ precipitate so as to form an $Mg_2Si$ precipitate,
wherein the aluminum alloy comprise:
silicon (Si) in an amount of about 9.6 to 12.0 wt %;
magnesium (Mg) in an amount of about 1.5 to 3.0 wt %;
zinc (Zn) in an amount of about 3.0 to 6.0 wt %;
iron (Fe) in an amount of about 1.3 wt % or less but greater than 0 wt %;
manganese (Mn) in an amount of about 0.5 wt % or less but greater than 0 wt %;
nickel (Ni) in an amount of about 0.5 wt % or less but greater than 0 wt %;
tin (Sn) in an amount of about 0.2 wt % or less but greater than 0 wt %; and
aluminum (Al) constituting the remaining balance of the aluminum alloy composition,
all the wt % based on the total weight of the aluminum alloy composition,
wherein a sum of amounts of Mg and Zn is of about 6 to 8 wt %.

14. The method of claim 13, wherein the primary aging is performed at a temperature of about 110 to 130° C. for about 10 to 24 hours.

15. The method of claim 13, wherein the secondary aging is performed at a temperature of about 160 to 180° C. for about 3 to 6 hours.

16. The method of claim 13, wherein the aluminum alloy further comprises at least one from copper (Cu) in an amount of about 0.3 wt % or less and tin (Ti) in an amount of about 0.3 wt % or less, based on the total weight of the aluminum alloy.

17. A vehicle comprising an aluminum alloy composition of claim 1.

* * * * *